US007448492B2

(12) United States Patent
Sutherland

(10) Patent No.: US 7,448,492 B2
(45) Date of Patent: Nov. 11, 2008

(54) CARRIER PACKAGE AND BLANK

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 488 days.

(21) Appl. No.: 11/187,531

(22) Filed: Jul. 22, 2005

(65) Prior Publication Data

US 2007/0017829 A1 Jan. 25, 2007

(51) Int. Cl.
*B65D 75/00* (2006.01)

(52) U.S. Cl. ..... 206/147; 206/434; 206/427

(58) Field of Classification Search ..... 206/147, 206/139, 140, 427, 429, 434
See application file for complete search history.

(56) References Cited

U.S. PATENT DOCUMENTS 2,849,111 A 8/1958 Fielding
2,928,541 A 3/1960 Fielding
3,669,342 A 6/1972 Funkhouser
5,060,792 A * 10/1991 Oliff ..... 206/140
5,131,588 A 7/1992 Oliff
5,180,100 A 1/1993 Shimizu
5,297,673 A * 3/1994 Sutherland ..... 206/147
5,351,878 A 10/1994 Cooper
5,472,090 A 12/1995 Sutherland
5,472,138 A 12/1995 Ingram
5,542,536 A * 8/1996 Sutherland ..... 206/427
5,551,556 A * 9/1996 Sutherland ..... 206/147
5,558,212 A * 9/1996 Sutherland ..... 206/147
5,558,213 A * 9/1996 Sutherland ..... 206/147
5,597,071 A * 1/1997 Sutherland ..... 206/434
5,664,401 A 9/1997 Portrait et al.
5,682,995 A * 11/1997 Sutherland ..... 206/429
5,692,614 A * 12/1997 Harris ..... 206/429
5,778,630 A 7/1998 Portrait et al.
5,853,088 A 12/1998 Saulas et al.
5,855,318 A 1/1999 Baxter
5,931,300 A 8/1999 Sutherland
5,937,620 A 8/1999 Chalendar
5,941,453 A 8/1999 Oliff
5,943,847 A 8/1999 Chalendar
5,947,367 A 9/1999 Miller et al.
5,975,286 A 11/1999 Oliff
6,019,220 A 2/2000 Sutherland
6,021,898 A 2/2000 Sutherland
6,021,899 A * 2/2000 Sutherland ..... 206/427
6,109,438 A 8/2000 Sutherland
6,158,586 A 12/2000 Muller
6,289,651 B1 9/2001 Le Bras
6,315,123 B1 11/2001 Ikeda
6,550,616 B2 4/2003 Le Bras
6,811,525 B2 11/2004 Culpepper (Continued)

FOREIGN PATENT DOCUMENTS

EP 0 509 749 A1 10/1992

(Continued)

*Primary Examiner*—Jila M. Mohandesi
*Assistant Examiner*—Jose S Stephens, III
(74) *Attorney, Agent, or Firm*—Womble Carlyle Sandridge & Rice, PLLC

(57) ABSTRACT

A wrap-around carrier package has side panels with inclined or tapered side edges that allow a greater surface area of containers accommodated within the carrier to be viewed.

12 Claims, 7 Drawing Sheets

U.S. PATENT DOCUMENTS

| | | | |
|---|---|---|---|
| 6,948,651 | B2 | 9/2005 | Ikeda |
| 2003/0000182 | A1 | 1/2003 | Portrait et al. |
| 2003/0132130 | A1 | 7/2003 | Le Bras |
| 2004/0243277 | A1 | 12/2004 | Bonnain et al. |
| 2004/0254666 | A1 | 12/2004 | Bonnain et al. |
| 2005/0001020 | A1 | 1/2005 | Garnier |

FOREIGN PATENT DOCUMENTS

| | | | |
|---|---|---|---|
| WO | WO 03/008292 | A2 | 1/2003 |

* cited by examiner

CARRIER PACKAGE AND BLANK

BACKGROUND

Wrap-around carrier packages are formed by wrapping a carrier blank around a group of containers and securing the ends of the blank together. The containers are held in place by the tightly wrapped carrier and also, typically, by heel cutouts through which the bottom portions of the containers extend. In conventional packages, however, the carrier side panels may unduly obscure the view of containers held within the carrier. Product information, brand information, logos, and other information printed on the containers may therefore be unavailable to potential customers.

SUMMARY

According to a first embodiment, a carrier package comprises a carrier having a top panel, a first side panel adjacent to the top panel, a second side panel adjacent to the top panel and disposed on a side of the carrier package opposite to the first side panel, a bottom panel, a first web portion adjacent to a first edge of the first side panel, a second web portion adjacent to a second edge of the first side panel, a third web portion adjacent to a first edge of the second side panel, and a fourth web portion adjacent to a second edge of the second side panel. The carrier accommodates a plurality of containers, and the edges of the first side panel and/or the second side panel can be inclined with respect to vertical.

According to the first embodiment, greater portions of the containers in the carrier package are visible from the exterior of the package. Potential consumers therefore have greater access to product and/or advertising information printed on the containers. Also, consumers may more easily grasp containers held within the carrier package. Also according to the first embodiment, the carrier can be constructed from a blank that occupies less area than conventional carriers, and the blank may be stagger nested with similar blanks during production.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWING FIGURES

DETAILED DESCRIPTION

Figure 1:
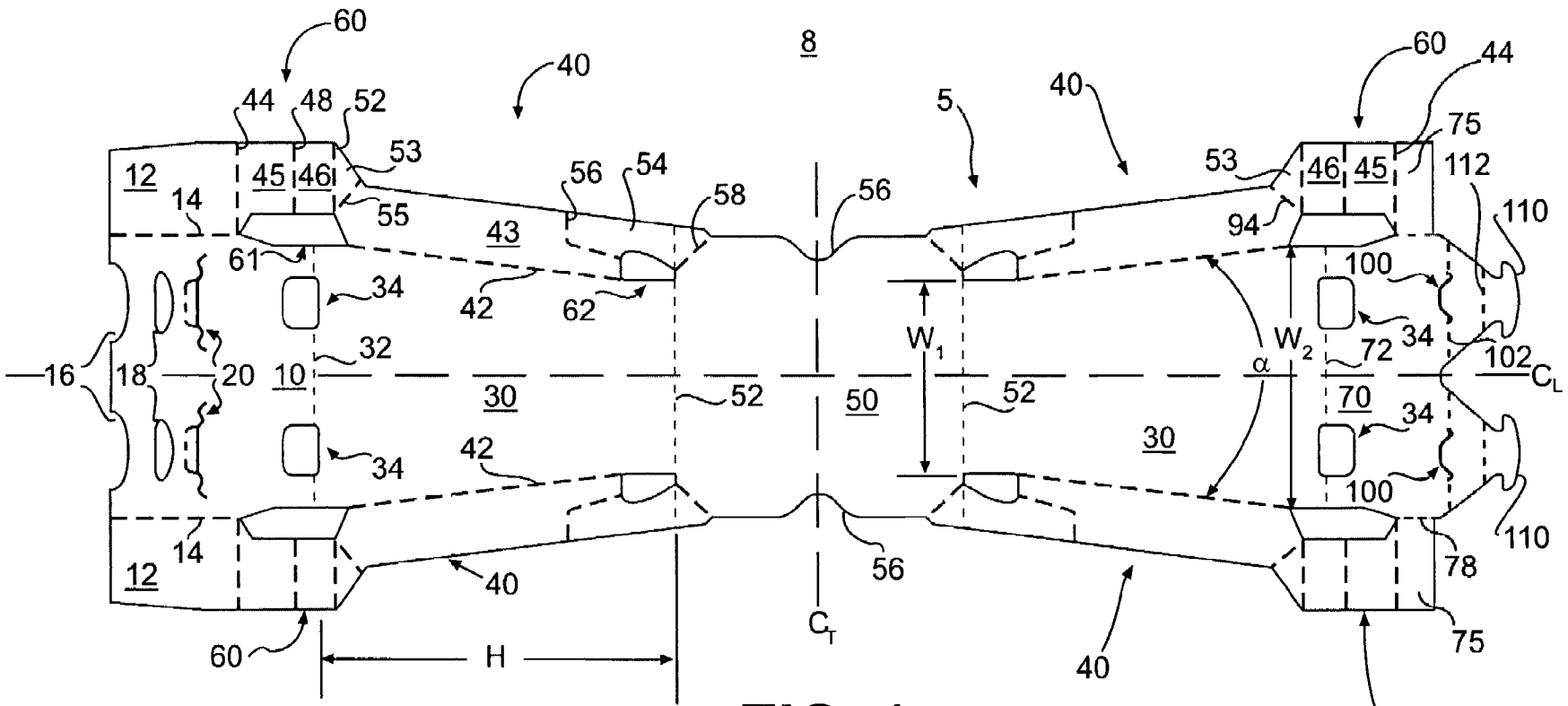
FIG. 1 is a plan view of a blank used to form a carrier package according to a first embodiment.

FIG. 1 is a plan view of a first, interior side 5 of a blank 8 used to form a carrier package 150 (illustrated in FIGS. 5-7) according to a first embodiment. The first side 5 will be disposed in the interior of the erected carrier package 150. As shown in FIG. 1, the blank 8 may be symmetric about a longitudinal center line $C_L$, and may be partially symmetric about a transverse center line $C_T$. Therefore, certain elements in the drawing figures share common reference numerals in order to reflect the longitudinal and transverse symmetries.

The blank 8 comprises a first bottom flap 10 foldably connected to a first side panel 30 at a first transverse fold line 32, a top panel 50 foldably connected to the first side panel 30 at a second transverse fold line 52, a second side panel 30 foldably connected to the top panel 50 at a third transverse fold line 52, and a second bottom flap 70 foldably connected to the second side panel 30 at a fourth transverse fold line 72. A web portion 40 is included on each side of each side panel 30, each web portion 40 comprising a top retention web 54, an intermediate web 43, and a bottom retention web 60. As shown in FIG. 1, the side panels 30 and the web portions 40 on either side of the top panel 50 may be constructed to be symmetric about the transverse center line $C_T$.

Figure 5:
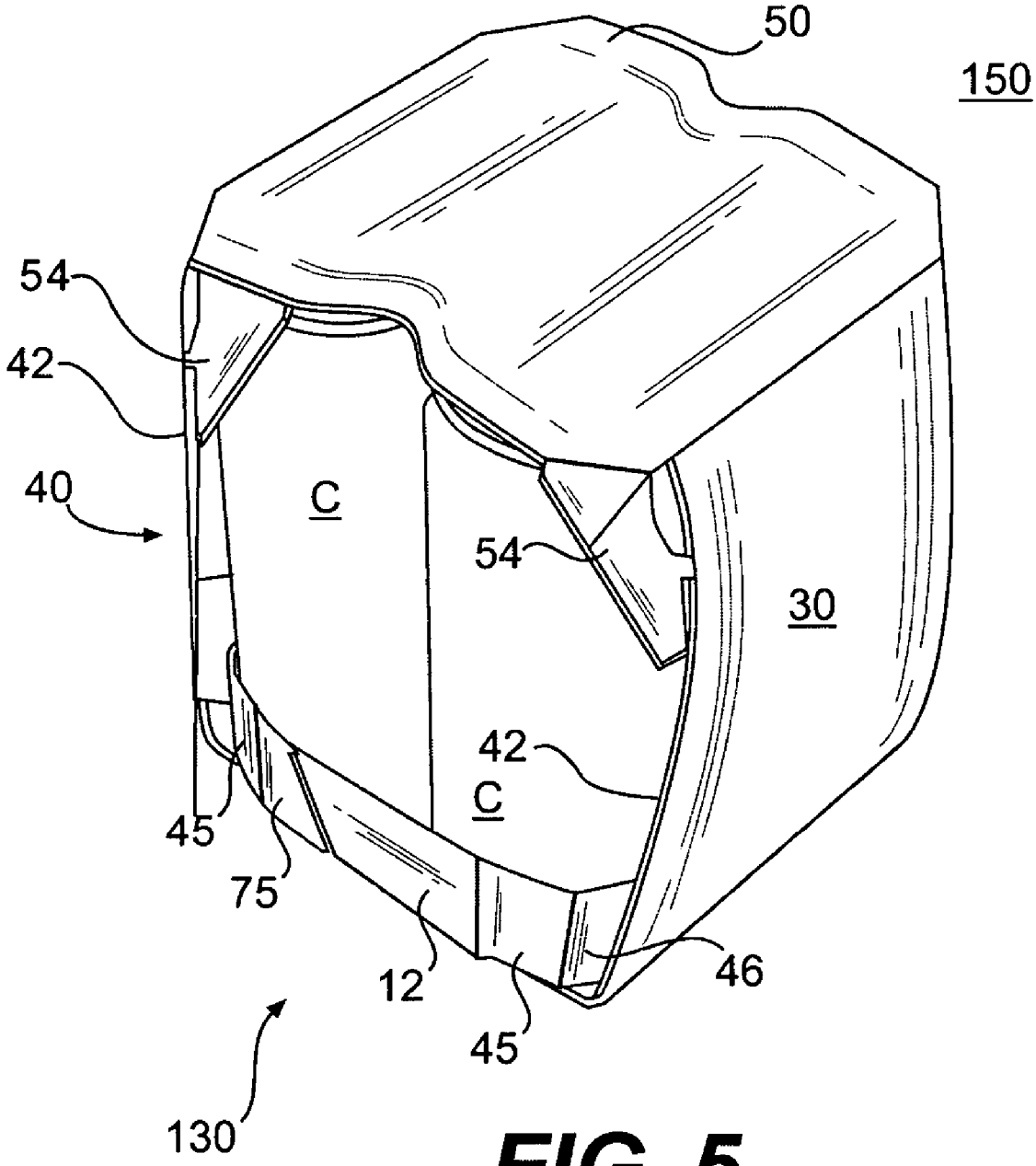
FIG. 5 is a perspective view of the erected carrier package loaded with containers.

The top panel 50 has a generally rectangular shape with truncated corners and arcuate cutouts 56 disposed along the longitudinally-extending edges of the top panel 50. The arcuate cutouts 56 can be shaped and sized so that the top panel 50 generally conforms to the cross section of containers C held within the finished carrier package 150 (FIG. 5).

The side panels 30 are connected to the web portions 40 by obliquely extending fold lines 42 that diverge from each other as they extend outwardly away from the top panel 50. The web portions 40 are defined by fold lines 42, 44, 48, 52, 55, 56, 58 and by cutouts 61, 62 in the blank 8. For the sake of simplicity of discussion, the web portions 40 are discussed below with reference to a single web portion 40. As shown in FIG. 1, the fold lines 42, 55, 56 and cutouts 61, 62 define an intermediate web 43 of a web portion 40. A top retention web 54 of the web portion 40 is foldably connected to the intermediate web 43 at the fold line 56, and to the top panel 50 at the fold line 58. A bottom retention web 60 of the web portion 40 comprises first, second and third bottom retention web panels 45, 46, 53 that are defined by the fold lines 44, 48, 52, 55.

The bottom retention webs 60 at the first bottom flap 10 end of the blank 8 (the left end in FIG. 1) are connected to primary end panels 12 at the fold lines 44. The primary end panels 12 are connected to the first bottom flap 10 at fold lines 14. The bottom retention webs 60 at the second bottom flap 20 end of the blank 8 (the right end in FIG. 1) are connected to secondary end panels 75 at the fold lines 44. The secondary end panels 75 are connected to the second bottom flap 70 at fold lines 78.

The first and second bottom flaps 10, 70 can include heel cutouts 34, located adjacent to the fold lines 32, that are sized to receive a bottom edge of a container C accommodated within the carrier package 150.

The first bottom flap 10, which is the inner bottom panel flap in the erected carrier package 150, includes cutouts forming primary female locking edges 18 that are adapted to engage primary male locking tabs 100 on the second bottom flap 70. The first bottom flap 10 also includes slits 20 adapted to receive outer secondary locking tabs 110 of the second bottom flap 70. The second bottom flap 70, which is the outer bottom flap in the erected carrier package 150, includes a fold line 102 which is interrupted by the slits that define the primary male locking tabs 100. The secondary male locking tabs 110 are connected along the fold line 102 and each tab includes an intermediate fold line 112. Although the locking elements are illustrated to demonstrate a typical bottom panel locking arrangement suitable for use with the carrier package of the invention, it should be understood that any desired effective form of bottom panel locking means may be employed. For example, glue or other adhesives, or other suitable fastening means, may be used to secure the bottom flaps 10, 70.

The fold lines 42 defining each side panel 30 diverge from one another by an angle of inclination α as they extend outwardly away from the top panel 50. The angle of inclination α provides each side panel 30 with a width $W_1$ at the fold lines 52 that is smaller than a width $W_2$ at the fold lines 32, 72. The angle α can be in the range of, for example, about 4-20 degrees. In other embodiments, the angle α can be in the range of, for example, about 8-16 degrees. The width $W_2$ of the side panels 30 in the vicinity of where the side panels 30 join the bottom flaps 10, 70 can be at least about 110% of the width $W_1$ of the side panels 30 in the vicinity of the fold line 52. In the erected carrier package 150, the angle α provides for increased visibility of containers C held within the carrier package 150. Erection of the carrier package 150 is discussed below with reference to FIGS. 2-5.

Figure 2:
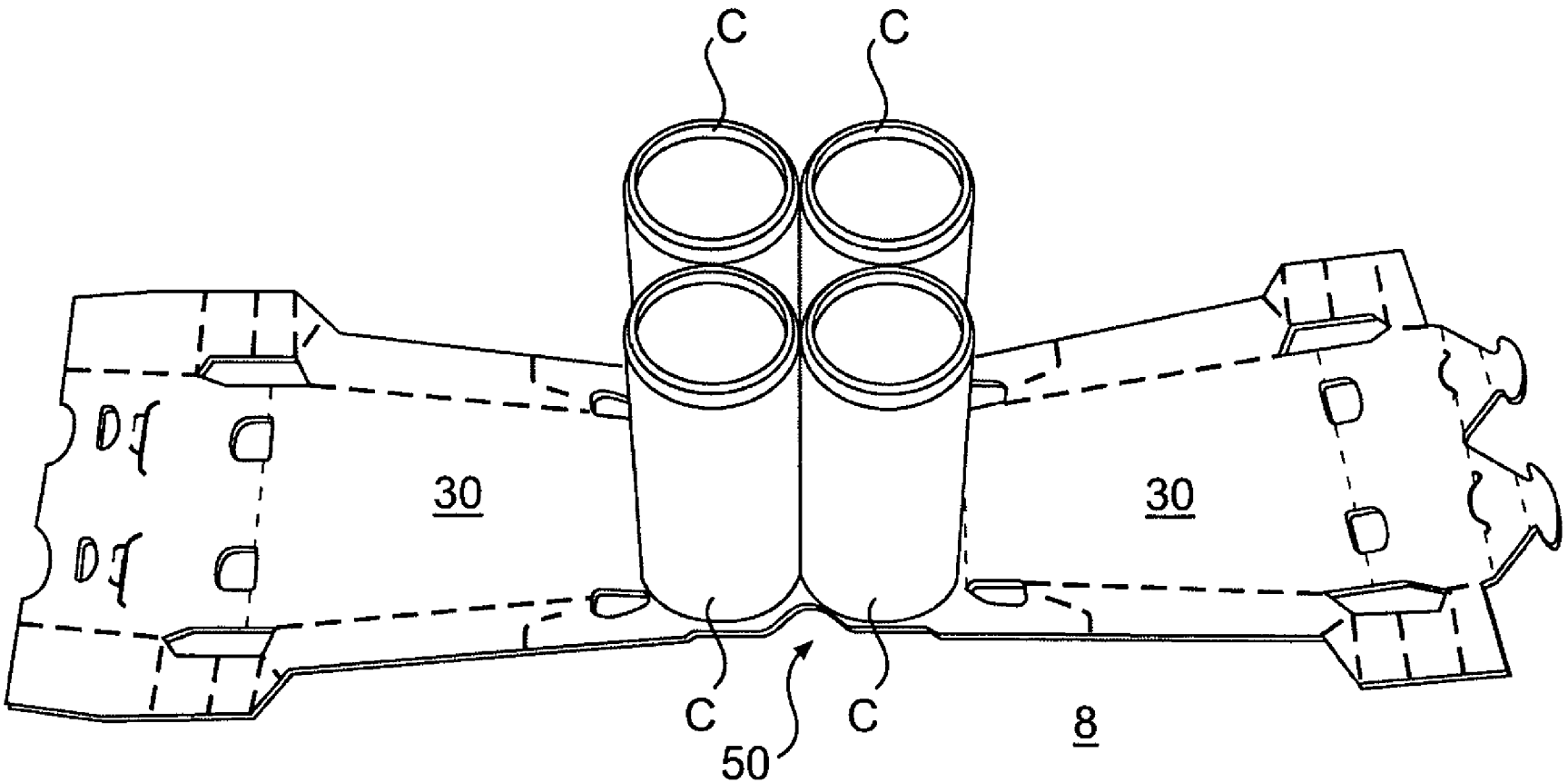
FIGS. 2-3 are perspective views of erection and loading of the carrier package.
Figure 3:
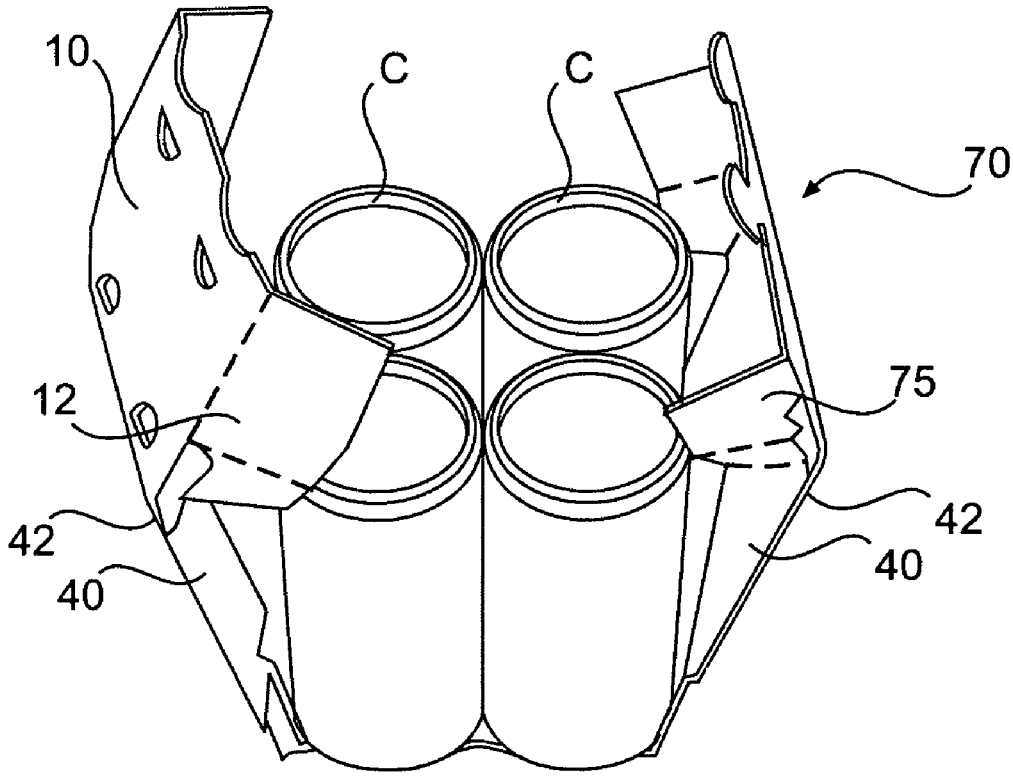

FIG. 2 illustrates an initial step in erection of the carrier package 150, in which containers C are placed top side down on the top panel 50. Referring to FIG. 3, the side panels 30 are then folded upwardly toward the containers C. As the side panels 30 are folded upwardly, the web portions 40 are tucked inwardly about the fold lines 42.

Figure 4:
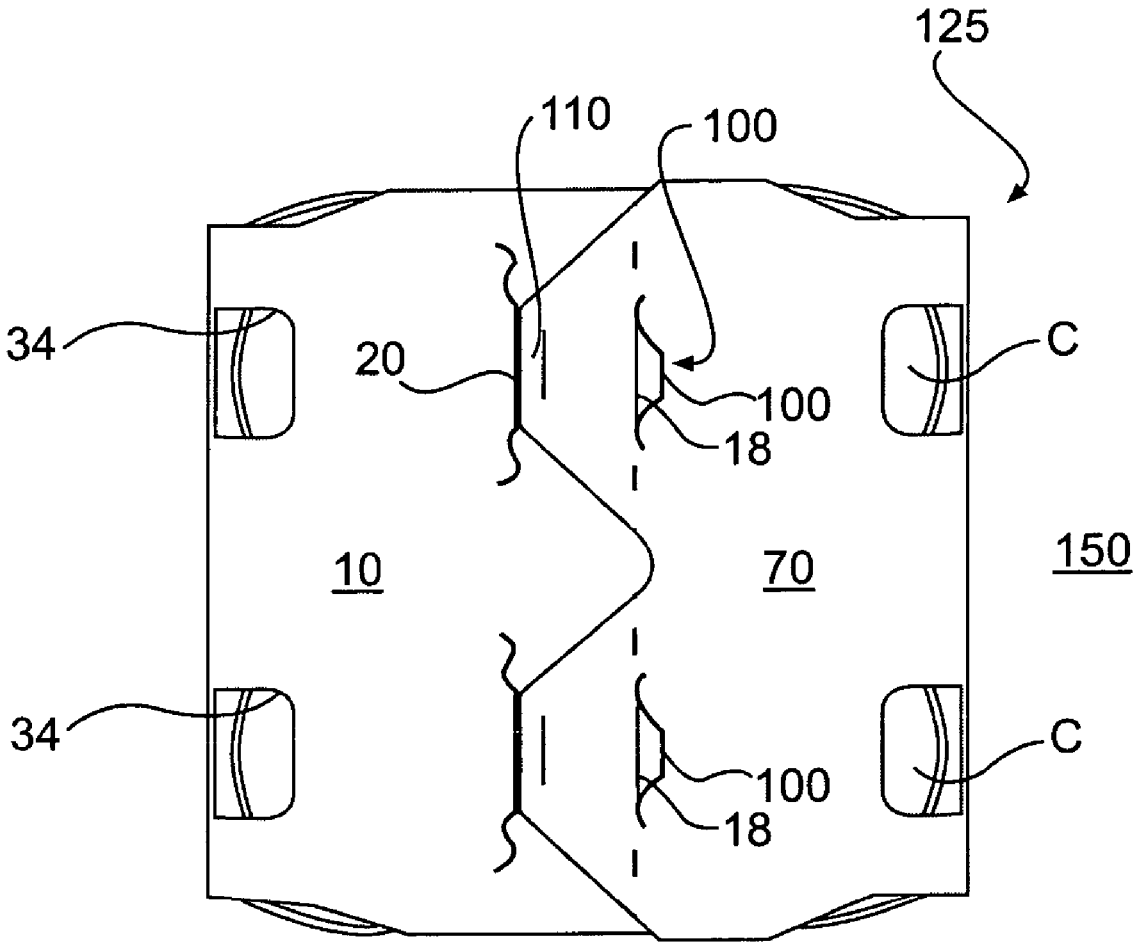
FIG. 4 is a bottom plan view of erection of the carrier package.

Referring to FIG. 4, the second bottom flap 70 is engaged with the first bottom flap 10 by engaging the primary female locking edges 18 of the first bottom flap 10 with the primary male locking tabs 100 of the second bottom flap 70. The outer secondary locking tabs 110 of the second bottom flap 70 are then pressed into the slits 20. As the flaps 10, 70 are pulled tightly together and the locking mechanisms are engaged, bottom portions of the containers C extend into the heel cutouts 34 in the flaps. When locked together, the first and second bottom flaps 10, 70 form a bottom panel 125.

Figure 6:
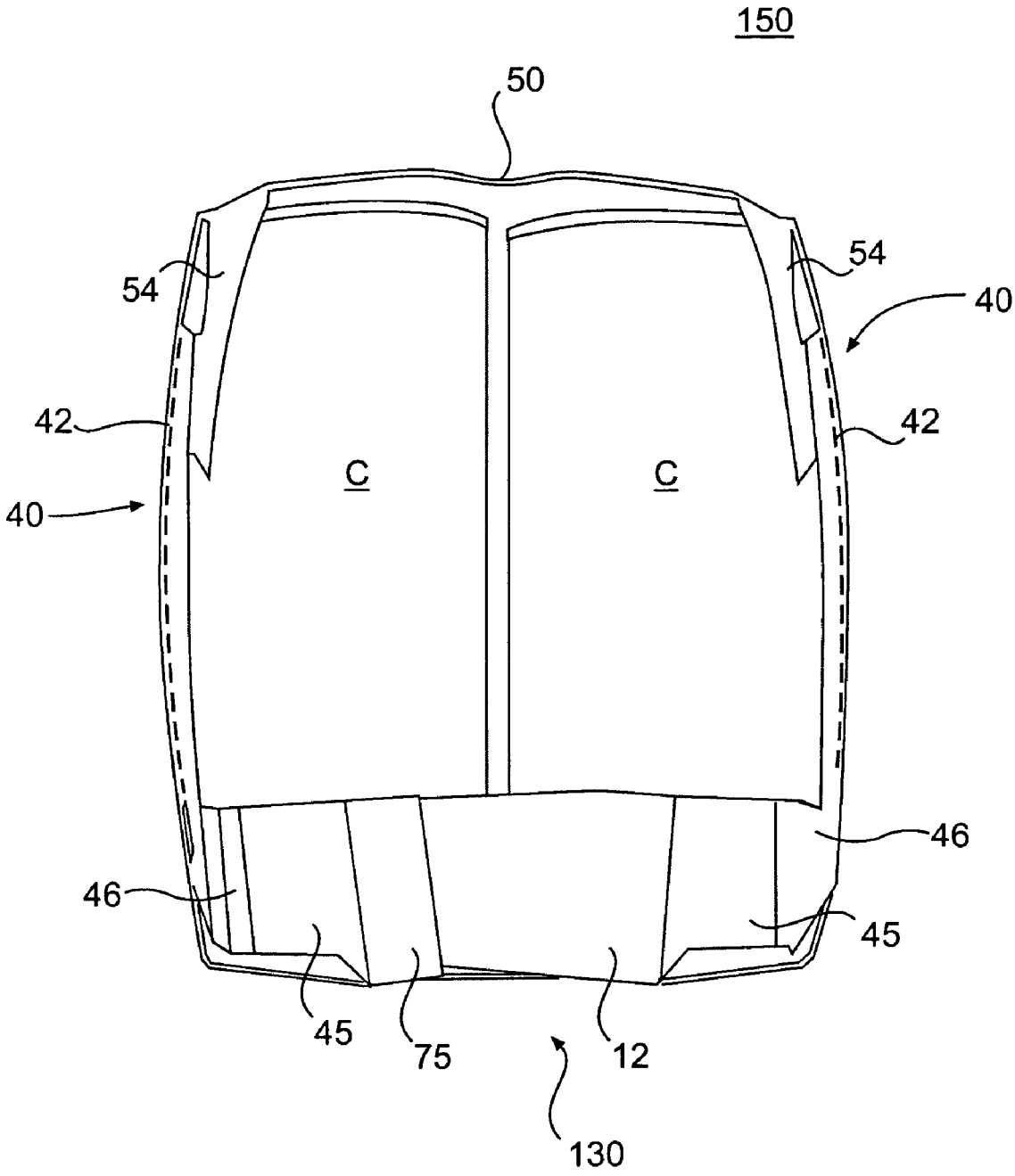
FIG. 6 is an end view of the carrier package.

FIG. 5 is a perspective view of the erected carrier package 150 including containers C accommodated therein, and FIG. 6 is an end view of the erected carrier package 150. The term "carrier package" generally refers to the erected carrier blank and the containers accommodated within the erected blank. As shown in FIG. 5, the ends of the carrier package 150 may be generally open, exposing the containers C to view, while the sides are partially closed by the side panels 30. As shown most clearly in FIG. 6, when the web portions 40 are folded inwardly about the fold lines 42, the top retention webs 54 abut and secure upper portions of the containers C. The bottoms of the containers C are abutted and secured by the panels 12, 45, 46, 75, which form first and second bottom retention walls 130 at first and second ends of the carrier 150, respectively.

Figure 7:
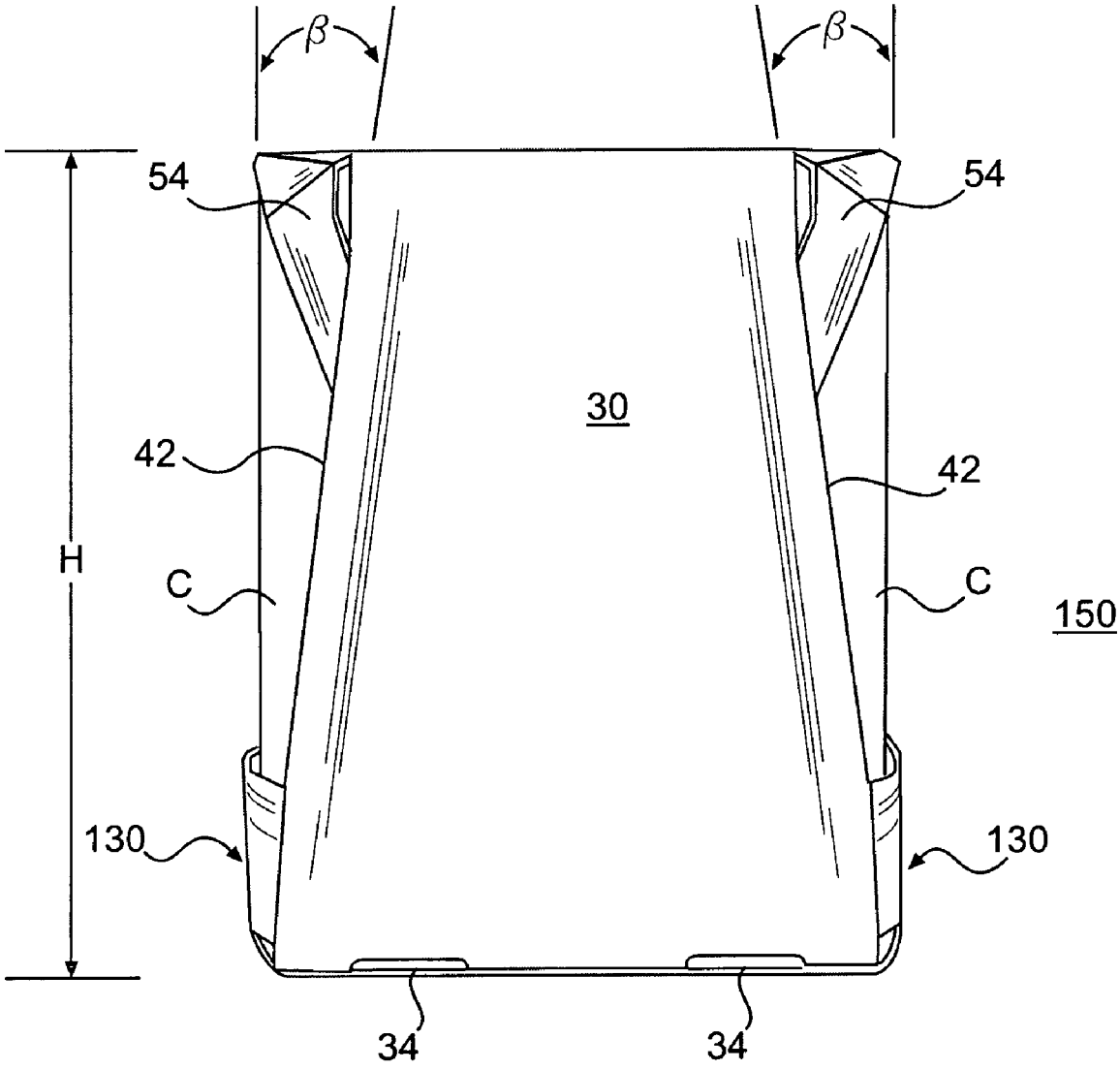
FIG. 7 is a side view of the carrier package.

FIG. 7 is a side view of the carrier package 150. FIGS. 5 and 7 illustrate the increased visibility for the containers C from the sides of the carrier package 150 provided by the inclined edges of the first and second side panels 30. Referring to FIG. 7, the angle of inclination β for the side edges of the side panels 30, which generally correspond to the fold lines 42, allows the sides of the containers C to be viewed from a side perspective of the carrier package 150. The angle β can generally be measured with respect to vertical, or, with respect to a sidewall of a container C. The increased exposed surface area of the containers C on the carrier package sides is desirable because, for example, prospective consumers of the carrier package 150 can view the containers C from a wide range of viewpoints. The inclined side edges of the side panels 30 may also allow for easier grasping, manipulating, rotating, and/or removal of the containers C from the carrier package 150. In the assembled carrier package 150, the angle β can be approximately α/2, and can be, for example, in the range of 4-8 degrees. The side edges of the side panels 30 may alternatively be described as non-orthogonal to a plane of the top panel 50 or a plane of the bottom panel 125, with which the side edges generally form an angle of 90° +/−β.

EXAMPLE 1

A carrier package 150 as illustrated in FIGS. 5-7 accommodated four, 8.3 fluid ounce, cylindrical containers C in a 2×2 (two columns and two rows) arrangement. The carrier package had a height H of about 5.25 in. The width $W_1$ of the side panels 30 at the top panel 50 was about 2.75 in. and the width $W_2$ at the bottom flaps 10, 70 was about 3.75 in. The carrier package was constructed of 0.018 ak paperboard. The angle α was about 12 degrees. The fold lines 42, 44, 48, 52, 55, 56, and 58 were cut/space lines with the cuts extending through the blank 8 (i.e., 100% cuts). The fold lines 32, 52, 72 were crease lines.

EXAMPLE 2

A carrier package 150 similar in construction to the carrier package of Example 1 is adapted to accommodate six 8.3 fluid ounce containers in a 2×3 (two columns and three rows) arrangement. Referring to FIG. 1, the width of the blank 8, measured vertically in FIG. 1, is increased to accommodate the third row of containers. The length of the blank 8, measured from left to right in FIG. 1, may be unchanged. The carrier package may be constructed of 0.016 or 0.018 ak paperboard. The angle α is about 12 degrees. The fold lines 42, 44, 48, 52, 55, 56, and 58 are cut/space lines with the cuts extending through the blank 8 (i.e., 100% cuts). The fold lines 32, 52, 72 are crease lines.

In the above embodiments, the carrier package 150 is shown as accommodating beverage cans. Other types of containers, however, can be accommodated within a carrier package according to the present invention. The dimensions of the blank 8 may also be altered, for example, to accommodate various container forms.

Additional containers C can be accommodated in a carrier package according to principles of the present invention, for example, by adjusting the length of the blank 8. For example, the top panel 50 and the first and second bottom flaps 10, 70 can be lengthened along the longitudinal direction of the blank 8 (measured from left to right in FIG. 1) in order to accommodate additional containers C. In one such embodiment, a carrier may be constructed that accommodates six containers arranged in three columns and two rows (3×2). The containers C can be, for example, 8.3 fluid ounce beverage cans.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carrier package to function at least generally as described above. The blanks can also be laminated to or coated with one or more sheet-like materials at selected panels or panel sections. Also according to the first embodiment, the carrier can be constructed from a blank that occupies less area than conventional carriers, and the blank may be stagger nested with similar blanks during production.

In accordance with the exemplary embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or panels adhered together by glue. The term "glue" is intended to encompass all manner of adhesives commonly used to secure carton panels in place.

The foregoing description of the invention illustrates and describes the present invention. Additionally, the disclosure shows and describes only selected preferred embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A blank for assembling into a wrap-around carrier package, the blank comprising:

a top panel;

a first side panel;

a second side panel;

at least one bottom flap foldably connected to at least one of the first and second side panels;

a first web portion foldably connected to a first side of the first side panel along a first fold line;

a second web portion foldably connected to a second side of the first side panel along a second fold line;

a third web portion foldably connected to a first side of the second side panel along a third fold line;

a fourth web portion foldably connected to a second side of the second side panel along a fourth fold line, the third fold line being disposed at a non-zero second angle with respect to the fourth fold line; and at least two primary end panels. one primary end panel being foldably connected to each of the first and second web portions, and at least two secondary end panels, one secondary end panel being foldably connected to each of the third and fourth web portions, wherein each web portion comprises an intermediate web, a bottom retention web foldably connected to the intermediate web, and a top retention web foldably connected to the intermediate web, and each bottom retention web comprises a first bottom retention panel, a second bottom retention panel and a third bottom retention panel, and the first fold line is disposed at a non-zero first angle with respect to the second fold line so that the first side panel tapers inwardly toward a center of the blank.

2. The blank of claim 1, wherein the first angle is approximately equal to the second angle.

3. The blank of claim 1, further comprising:

at least one male locking member on the at least one bottom flap; and at least one female locking member on the at least one bottom flap.

4. The blank of claim 1, wherein the at least one bottom flap comprises:

a first bottom flap foldably connected to the first side panel; and a second bottom flap foldably connected to the second side panel.

5. The blank of claim 4, further comprising locking means for locking the first bottom flap to the second bottom flap.

6. The blank of claim 3, wherein the first side panel is wider at the at least one bottom flap than at the top panel.

7. The blank of claim 1, wherein the first angle is at least four degrees.

8. A blank for assembling into a wrap-around carrier package, the blank comprising:

a top panel;

a first side panel foldably connected to a first side of the top panel;

a second side panel foldably connected to a second side of the top panel;

a first bottom flap foldably connected to the first side panel;

a second bottom flap foldably connected to the second side panel;

a first web portion foldably connected to a first side of the first side panel along a first fold line;

a second web portion foldably connected to a second side of the first side panel along a second fold line, wherein the first fold line is disposed at a non-zero first angle with respect to the second fold line so that the first side panel tapers inwardly toward a center of the blank;

a third web portion foldably connected to a first side of the second side panel along a third fold line; and a fourth web portion foldably connected to a second side of the second side panel along a fourth fold line, wherein each web portion comprises an intermediate web foldably connected to an adjacent one of the side panels, a bottom retention web, and a top retention web, a cutout is formed in the blank at the junction of each intermediate web and the side panel to which it is foldably connected, and each bottom retention web comprises a first bottom retention panel, a second bottom retention panel and a third bottom retention panel, the first, second and third bottom retention panels being adjacent to one of the cutouts in the blank.

9. The blank of claim 8, wherein each web portion comprises:

an intermediate web panel;

a bottom retention web; and a top retention web.

10. The blank of claim 8, further comprising locking means for locking the first bottom flap to the second bottom flap.

11. A carrier package, comprising: a carrier, comprising:

a top panel;

a first side panel adjacent to the top panel;

a second side panel adjacent to the top panel and disposed on a side of the carrier package opposite to the first side panel;

a bottom panel;

a first web portion adjacent to a first edge of the first side panel;

a second web portion adjacent to a second edge of the first side panel;

a third web portion adjacent to a first edge of the second side panel;

a fourth web portion adjacent to a second edge of the second side panel;

a first end wall at least partially closing a first end of the carrier; and a second end wall at least partially closing a second end of the carrier; and four containers located within the carrier and arranged in two columns and two rows, wherein the side panels taper inwardly toward the top panel, each web portion comprises an intermediate web foldably connected to an adjacent one of the side panels, a bottom retention web, and a top retention web, a cutout is formed at each end of each intermediate web, and each bottom retention web comprises a first bottom retention panel.

a second bottom retention panel and a third bottom retention panel, the first, second and third bottom retention panels being adjacent to one of the cutouts in the blank.

12. The carrier package of claim 11, wherein the bottom panel comprises first and second bottom flaps and wherein the first and second side panels taper at an angle of at least four degrees.

* * * * *